United States Patent [19]

Euteneuer et al.

[11] 4,447,167

[45] May 8, 1984

[54] STACKING DEVICE FOR DATA CARRIERS

[75] Inventors: Edmund Euteneuer, Grünebach; Friedhelm Eckhardt, Siegen, both of Fed. Rep. of Germany

[73] Assignee: U.S. Philips Corporation, New York, N.Y.

[21] Appl. No.: 330,635

[22] Filed: Dec. 14, 1981

[30] Foreign Application Priority Data

Dec. 16, 1980 [DE] Fed. Rep. of Germany ..... 3047277

[51] Int. Cl.[3] ..... B41J 11/58; B41J 13/10

[52] U.S. Cl. ..... 400/625; 271/177; 271/207; 400/629

[58] Field of Search ..... 400/625, 636, 647, 629; 271/177, 180, 181, 220, 207

[56] References Cited

U.S. PATENT DOCUMENTS

| | | | |
|---|---|---|---|
| 4,147,341 | 4/1979 | Wurscher et al. | 271/122 |
| 4,253,652 | 3/1981 | Steinhilber | 271/8 R |
| 4,371,276 | 2/1983 | Mitrovich et al. | 400/625 |

FOREIGN PATENT DOCUMENTS

| | | |
|---|---|---|
| 2222596 | of 0000 | Fed. Rep. of Germany . |
| 2452798 | of 0000 | Fed. Rep. of Germany . |
| 2854695 | of 0000 | Fed. Rep. of Germany . |

OTHER PUBLICATIONS

*IBM Tech. Disc. Bulletin,* by F. W. Doolittle, vol. 13, No. 10, Mar. 1971, pp. 3109–3110, 271–180.

IBM Technical Disclosure Bulletin, vol. 20, No. 6, Nov. 1977.

*Primary Examiner*—Paul T. Sewell

*Attorney, Agent, or Firm*—David R. Treacy

[57] ABSTRACT

A stacking device for stacking data carriers, especially multi-sheet forms, either face up or face down by selecting the orientation of a reversible, detachable magazine. The carriers are ejected between symmetrically arranged feed rollers. A pivoting diverter, and moderately spring-biased guides extending between the feed roller shafts, direct an ejected carrier over that feed roller which is on the selected side of the plane of symmetry of the feed rollers.

7 Claims, 5 Drawing Figures

23
2
7
25
25a
26
25a
18
17
25
4
1a
10
1
10a
3
9a
9
13
28
12
11
14
8
15
14

STACKING DEVICE FOR DATA CARRIERS

BACKGROUND OF THE INVENTION

The invention relates to a stacking device for data carriers ejected from a printing mechanism, which device comprises a stacking magazine and two feed rollers arranged at the underside of said magazine, the data carrier, after being fed in, being diverted with its lower edge over one of said rollers and being transferred to the stacking magazine which is inclined relative to the feed direction.

Such a stacking device is known from DE-AS No. 26 06 697, to which U.S. Pat. No. 4,147,341 corresponds, which device forms part of a collation apparatus. After a data carrier has been processed it is ejected by the printing mechanism in an upward direction and is gripped by two feed rollers which feed the data carrier to the stacking magazine. Under its own weight the data carrier is fed in with its lower edge being guided by the feed roller and is subsequently dropped into the magazine, which is inclined relative to the plane of the feed rollers and which is stationarily arranged on the collation apparatus. The two feed rollers are so arranged on the stacking magazine that they are slightly offset relative to each other, which ensures that the data carrier is always transported in one direction.

Moreover, a stacking device is known from DE-OS No. 22 22 596, in which device the fed-in data carriers are pressed onto the stationary bottom of the stacking magazine by one or more biased leaf springs. Thus, said springs oppose insertion of the data carrier. For this reason one of the two feed-in rollers is constructed as ratchet.

A disadvantage of this is that the feed roller always diverts the data carrier in one direction towards the stationary magazine. Moreover, damaging or folding of the data carrier is not unlikely with said second device.

SUMMARY OF THE INVENTION

It is the object of the invention to construct a stacking magazine and the data-carrier feed-in mechanism in such a way that stacking is effected in such a way that the data carrier first ejected is disposed either with its front side up or down, as required. This enables the stacking sequence of the data carriers to be selected so that the last data carrier processed is always visible or that the data carriers are stacked in the sequence in which they have been removed from a feed magazine prior to processing. In this respect data carrier is to be understood to mean a single sheet, a multi-sheet form or envelopes.

The said object is achieved in that the stacking magazine is detachable, in that mounts for placing the stacking magazine optionally on the one or the other side of the feed rollers are arranged symmetrically relative to the feed rollers on both sides, in that the feed rollers transport the data carriers in the symmetry plane of the mounts, and in that the stacking magazine comprises one or more moderately spring-biased guides, whose free ends extend through the symmetry plane in order to divert the data carriers over the roller which is nearest to the magazine into the stacking magazine. This enables the stacking magazine to be arranged with its underside on the one mount or on the other mount after rotation through 180°, as required. The feed rollers feed the data carrier in the symmetry plane between the two possible positions of the stacking magazine.

For comparatively unstable data carriers, for example pliant multi-sheet forms or crinkled sheets the stacking space in the stacking magazine should be narrow. This is achieved if the stacking magazine has a pivotal bottom part, which is spring-biased towards the nearest feed roller. As a result of this the stacking space remains narrow until the stacking magazine is full.

Moreover, the invention has the advantage that when a plurality of identical stacking magazines are employed the stack of data carriers need not be removed from the stacking magazine, but may be removed together with the magazine, to be kept therein for subsequent use.

In a further embodiment of the invention a shaft is arranged above the feed rollers and in the symmetry plane, on which shaft a double lever is mounted, an arm of which projects into the stacking magazine regardless of the position of said magazine relative to the feed rollers, which lever is operable to actuate a stationary switch arranged outside the stacking magazine. When the last data carrier has been placed onto the stack the arm which projects into the stacking magazine is pivoted and the switch is actuated, thereby signalling that a stacking magazine is full and that stacking should be discontinued.

Since data carrier transport is effected independently of the positions of the stacking magazine and the shaft of the double lever is disposed in said transport path for the same reasons, it is not unlikely that the data carrier is deflected in the wrong direction. Diverting it into the correct direction by means of the spring-biased guide plates is then no longer possible. For this reason a second double lever is pivotally mounted on the shaft and when the stacking magazine is mounted, is automatically pivoted in such a way that the data carrier, before its upper edge has reached the location of the shaft is already moved in the desired direction towards the stacking magazine. The two double levers can pivot independently of each other.

An embodiment of the invention will be described in more detail, by way of example.

DESCRIPTION OF THE PREFERRED EMBODIMENTS

Figure 1:
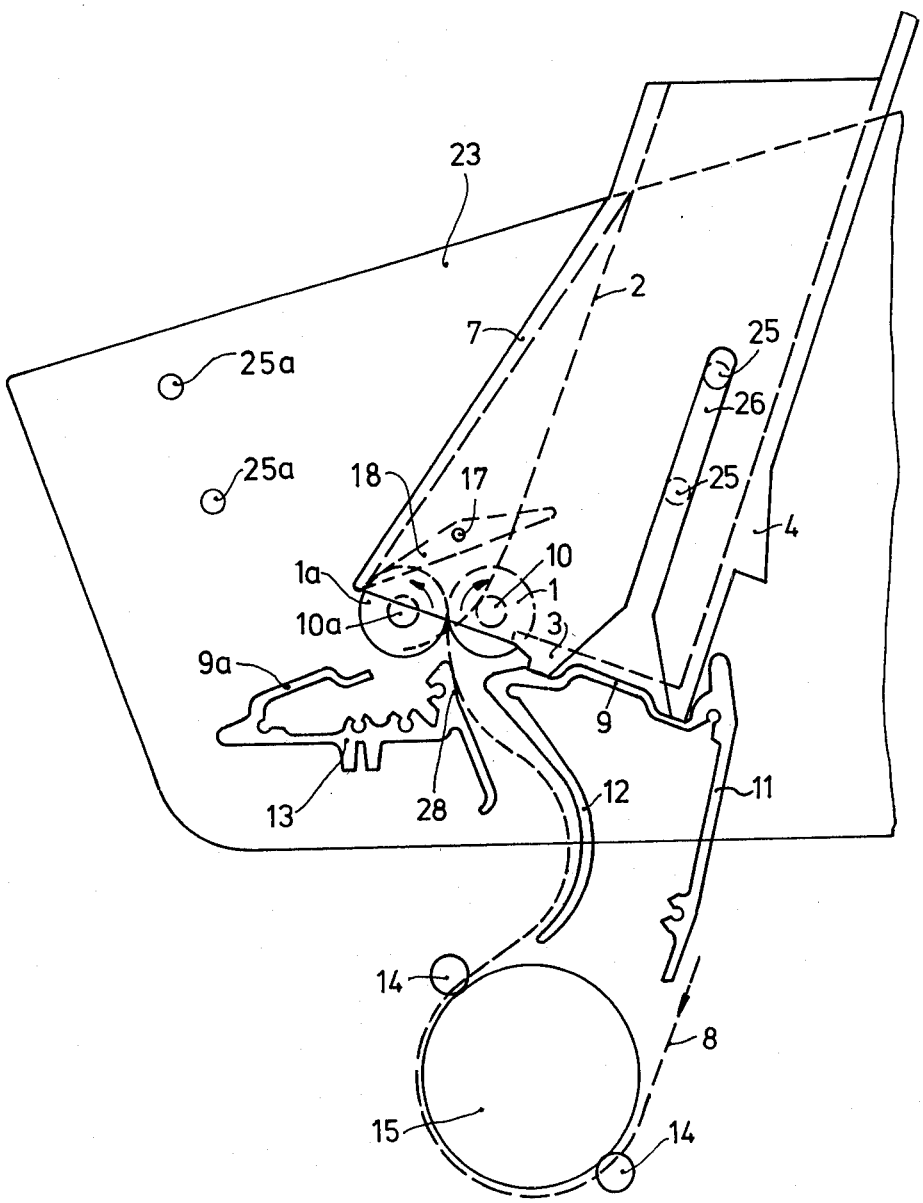
FIG. 1 shows the stacking device in accordance with the invention with the stacking magazine in the rearmost position.

In the embodiment shown the decollation device is detachably arranged above the printing mechanism, of which only the printing cylinder 15 and its pressure rollers 14 are shown, the record carrier 8 to be stacked being fed into the device from below. It is irrelevant how the record carrier is fed to the printing cylinder for the purpose of printing. The record carrier is guided by guide plates 11 and 12, which form part of the mount 9 for the interchangeable stacking magazine 4.

The device comprises two side walls 23 and 24, which are interconnected by the guide plates 11 and 12 and the connecting plate 13. The drive shaft 10 is journalled in the side walls 23 and 24, on which shaft two or more feed rollers 1 are arranged. Each feed roller 1 is associated with a further feed roller 1*a*, which is mounted for rotation on a separate shaft 10*a*. Instead of separate shafts 10*a* it is possible to use one continuous spindle. A switching shaft 17 is journalled in the side wall 23 and its end which projects into the stacking magazine 4 carries two double levers, an eccentric 22 being mounted at its end which projects from the device and being adapted to actuate a switch 21.

Furthermore, the side walls 23 and 24 each comprise a pair of studs 25 and 25*a* respectively, which serve for retaining the stacking magazine 4. For this purpose the stacking magazine 4 has a mounting slot 26 and 26*a* respectively in its narrow side walls. Each of said mounting slots widens towards the bottom 3 of the magazine, so that after insertion of the stacking magazine 4 between the side walls 23 and 24 the studs 25 and 25*a* respectively engage the slots 26 and 26*a*. The stacking magazine 4 is inserted between the side walls 23 and 24 until the magazine bottom abuts upon the mount 9. The mount 9 and the magazine bottom 3 are constructed so that the stacking magazine cannot be shifted with respect to the mount 9.

The connecting plate 13 has a mount 9*a* which is identical to the mount 9, on which mount 9*a* the stacking magazine 4 may also be placed. When the stacking magazine 4 is in the position shown in FIG. 1 it can be brought into the position shown in FIG. 2 by withdrawing it from the device in the upward direction, turning it through 180° about its longitudinal axis, and subsequently inserting it from above between the side walls 23 and 24 to engage the studs 25*a* until the magazine bottom 3 abuts upon the mount 9*a*.

Figure 2:
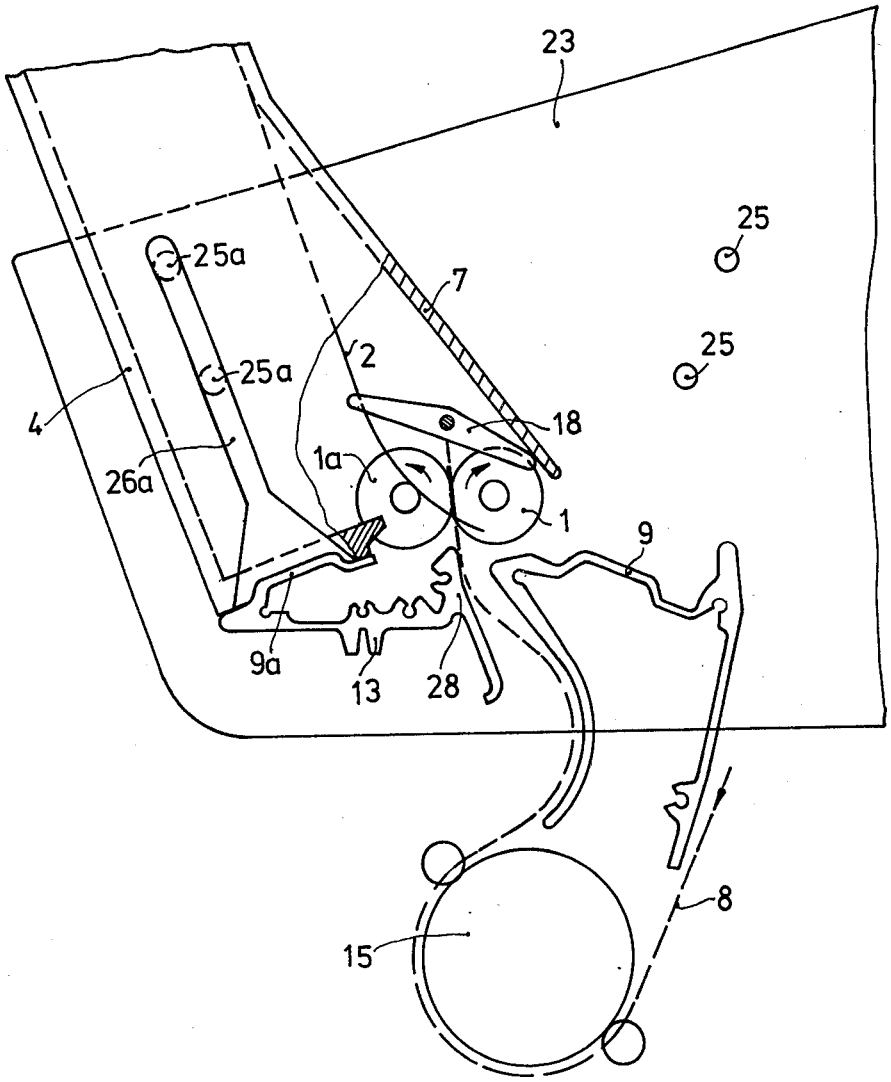
FIG. 2 shows the stacking device with the stacking magazine in the frontmost position after rotation through 180°.

For this dual use of the stacking magazine 4 the feed rollers 1 and 1*a* should be arranged between the mounts 9 and 9*a* in such a way that the plane through the tangent lines to the two feed rollers 10 and 10*a* is disposed symmetrically relative to the mounts. Moreover, the feed rollers 1 and 1*a* are situated above the mounts 9 and 9*a*, so that they partly project into the stacking magazine 4 when said magazine has been fitted. Moreover, the connecting plate 13 has a feed edge 28 which is arranged so that the record carrier fed in via the guide plate 12 is automatically guided into the tangential plane of the feed rollers. When the feed rollers 1 and 1*a* are rotated in the direction of the arrow, the record carrier is guided into the stacking magazine by the front wall 7 of magazine which is located above the rollers. Then it may happen that as soon as the lower edge of the record carrier emerges from the feed rollers it is positioned on the left-hand feed roller 1*a* and the record carrier is not fed into the magazine by the movement of said roller but away from said stacking magazine. In order to preclude this, a double lever, which functions as a diverter 18, is arranged above the feed rollers 1 and 1*a* to be freely movable on the switching shaft 17. The edge of the front wall 7 pivots said diverter 18 in such a way on the switching shaft 17 that regardless of whether the stacking magazine 4 is in the rear (FIG. 1) or front position (FIG. 2) the longitudinal axis of said diverter is always oriented in the direction of the stacking magazine 4. As a result of this, the inserted record carrier is automatically given a greater deflection towards the stacking magazine, which ensures that the lower edge of the record carrier is driven by the feed roller 1 and not by the feed roller 1*a*. In the position of the stacking magazine 4 as shown in FIG. 2 the lower edge of the record carrier is obviously moved by the feed roller 1*a* and not by the feed roller 1. This movement of the record carrier is promoted by the guides or springs 2 arranged inside the stacking magazine 4. As shown in the drawing, the guides 2 have upper ends fixed to the magazine front wall 7, and lower ends which extend through the plane of symmetry, distal portions of the guides extending below the shafts 10, 10*a*. Suitably, guides or springs 2 are slightly biased in such a way that they act on the shafts 10 or 10*a* with moderate force, depending upon orientation of the magazine 4. It is also effective to arrange a guide spring sideways of each feed roller.

Figure 3:
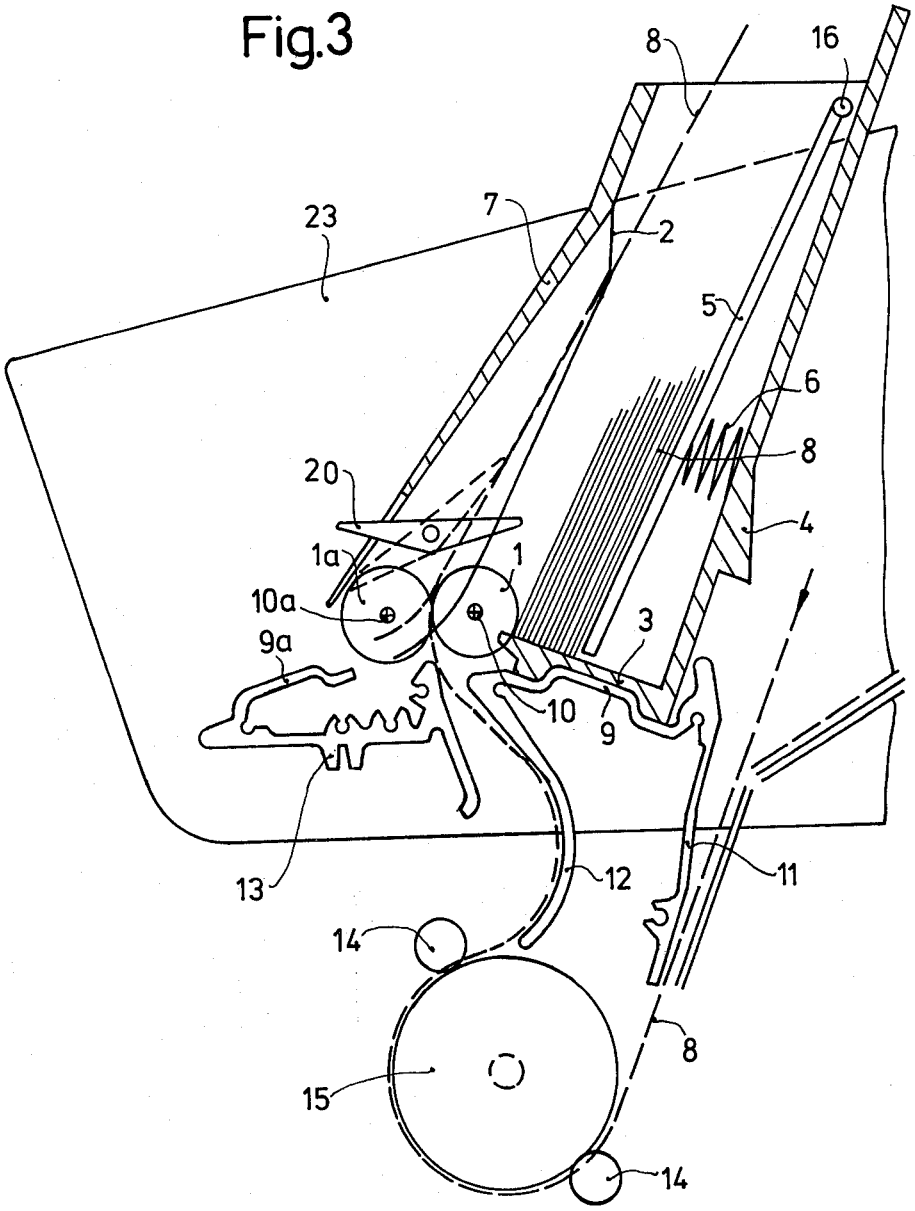
FIG. 3 is a partly sectional view of the stacking device shown in FIG. 1.
Figure 4:
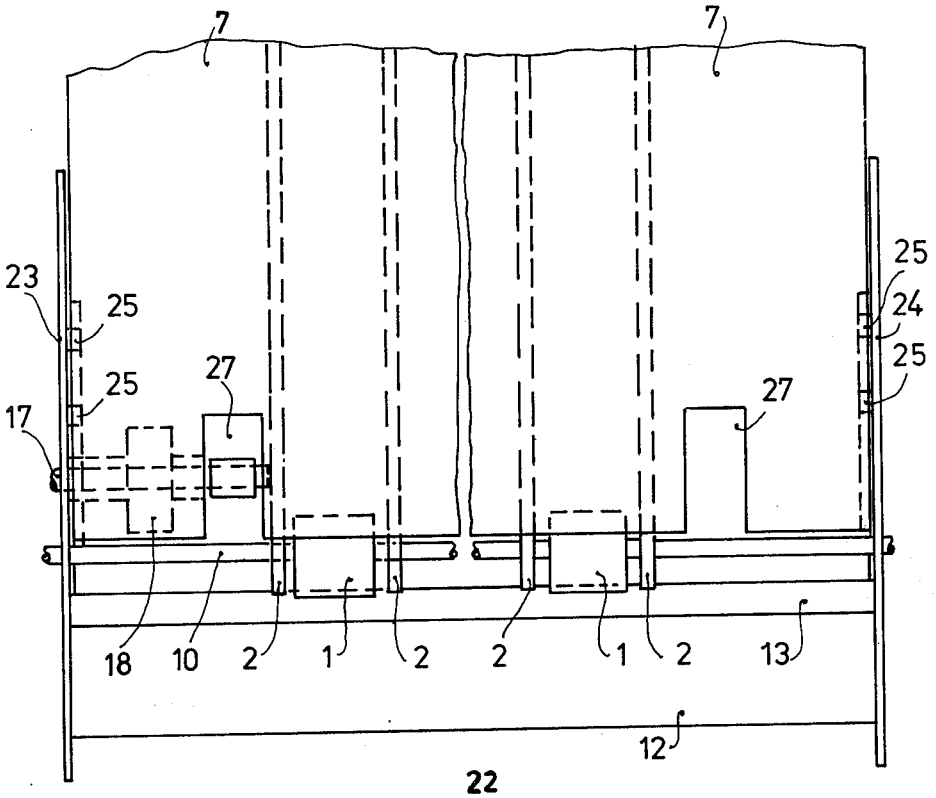
FIG. 4 is a front view of the stacking device shown in FIG. 1.
Figure 5:
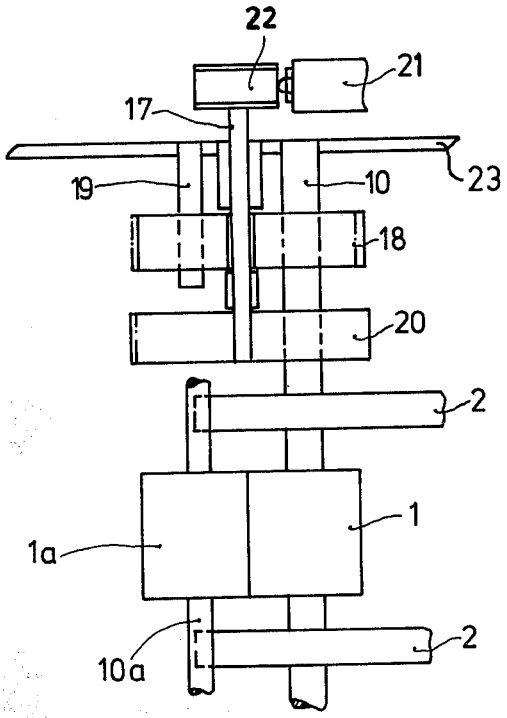
FIG. 5 is a partial plan view of the stacking device.

For a correct stacking of the record carriers, especially when said record carriers are larger, such as multi-sheet forms or envelopes, it is important that the space between the uppermost record carrier on the stack and the nearest feed roller 1 or 1*a* is very small. In order to achieve this, as can be seen in FIG. 3 a spring-loaded pivotal plate 5 is arranged to be pivotable about the mounting point. The spring 6 ensures that the uppermost record carrier is always lightly urged against the feed roller 1 or 1*a*. When the stacking magazine 4 is not full the record carriers which are fed in deflect the double lever 20, which is rigidly connected to the switching shaft 17, only slightly, so that the switch 21 is not actuated via the eccentric. However, when the stacking magazine 4 is full, the double lever 20 is ultimately deflected into the dashed position shown in FIG. 3 as the number of record carriers on the stack increases. Via the eccentric 22 the switch 21 is then actuated and the feed-in of further record carriers is discontinued.

The guide springs 2 act on the spindles 10 and 10*a* respectively with a moderate pressure. The length of each spring has been selected so that upon deflection by the upper edge of the inserted record carrier the spring is positioned against the lower side of the outer shaft 10*a* or 10 respectively and is thereby lifted off the surface of the other shaft 10 or 10*a* respectively to clear the path for the record carrier. As a result of this the lower edge of the inserted record carrier is guided onto the surface of the driving feed roller 1 or 1*a* respectively.

In order to prevent tipping over of the diverter 18 when the stacking magazine 4 is fitted a bolt 19 is mounted in the side wall 23, against which bolt the diverter 18 rests when it is tilted by the free edge of the front wall 7 of the stacking magazine 4.

In the front wall 7 of the stacking magazine 4 slots 27 are formed which permit the free pivotal movement of the double lever 20.

What is claimed is:

1. A stacking device for data carriers ejected from a printing mechanism, said device comprising a detachable stacking magazine; two feed rollers arranged on respective roller shafts at the underside of said magazine, and defining a symmetry plane; means for selectively mounting said magazine for stacking to a selected side of said plane; and means for diverting an ejected carrier toward said selected side into the magazine, characterized in that said stacking magazine comprises one or more moderately spring-biased guides disposed above and spaced from said rollers, fixed to the magazine, said guides having free ends extending through said symmetry plane and having a distal portion extending below said roller shafts, arranged to divert the ejected data carriers over that roller which is on the selected side of said plane into the stacking magazine, and further characterized in that the device comprises a switching shaft arranged above the feed rollers, extending in said plane of symmetry; a double lever mounted on the switching shaft, a respective arm of the lever projecting into the stacking magazine responsive to the placement of the magazine on the respective side of the symmetry plane; a switch mounted to said device outside the stacking magazine; and means for actuating the switch responsive to pivoting of the double lever in either direction for providing an electrical signal when a magazine has been filled with ejected carriers.

2. A device as claimed in claim 1, characterized in that the bottom of the stacking magazine has at least one opening, the feed roller on the selected side of said plane of symmetry projecting partly into said at least one opening.

3. A device as claimed in claim 2, characterized in that the stacking magazine further includes a plate for defining the position of the bottom of a stack of ejected carriers, said plate being pivotally connected in the magazine and having a spring biasing said plate toward the nearer feed roller.

4. A device as claimed in claim 1, characterized in that a second double lever is mounted on said switching shaft for pivotal movement about the switching shaft, said second lever being disposed within the magazine which is mounted by the mounting means, said second lever being engaged by a portion of said magazine so as to pivot the lever to a direction in which the lever engages and diverts a carrier being ejected toward the selected side of said plane of symmetry.

5. A stacking device for data carriers ejected from a printing mechanism, said device comprising a detachable stacking magazine; two feed rollers arranged on respective roller shafts at the underside of said magazine, and defining a symmetry plane; means for mounting said magazine for stacking to a selected side of said plane; and means for diverting an ejected carrier toward said selected side into the magazine, characterized in that said device includes a side wall and a diverter lever pivotally mounted to the side wall about a pivot axis lying in said plane of symmetry above the feed rollers, said diverter lever extending into the stacking magazine and arranged so that placing of the magazine pivots the lever by engagement of the lever with a magazine wall, such that an ejected carrier is diverted over that roller which is on the selected side of said plane of symmetry into the stacking magazine.

6. A device as claimed in claim 5, characterized in that the bottom of the stacking magazine has at least one opening, the feed roller on the selected side of said plane of symmetry projecting partly into said at least one opening.

7. A device as claimed in claim 6, characterized in that the stacking magazine further includes a plate for defining the position of the bottom of a stack of ejected carriers, said plate being pivotally connected in the magazine and having a spring biasing said plate toward the nearer feed roller.

* * * * *